US005518229A

United States Patent [19]

Tahara et al.

[11] Patent Number: 5,518,229

[45] Date of Patent: May 21, 1996

[54] NEGATIVE FILM ACCUMULATING APPARATUS

[75] Inventors: Toshiro Tahara; Tadashi Seto, both of Kanagawa, Japan

[73] Assignee: Fuji Photo Film Co., Ltd., Kanagawa, Japan

[21] Appl. No.: 270,218

[22] Filed: Jul. 1, 1994

Related U.S. Application Data

[63] Continuation of Ser. No. 53,825, Apr. 29, 1993, abandoned, which is a continuation of Ser. No. 833,519, Feb. 11, 1992, abandoned.

[30] Foreign Application Priority Data

Feb. 20, 1991 [JP] Japan ..... 3-026206

[51] Int. Cl.[6] ..... B65H 29/46

[52] U.S. Cl. ..... 271/180; 271/188; 271/209; 271/220; 271/224; 206/455

[58] Field of Search ..... 271/177, 180, 271/181, 188, 207, 209, 211, 220, 221, 222, 223, 224, 161, 265; 206/455

[56] References Cited

U.S. PATENT DOCUMENTS

| | | | |
|---|---|---|---|
| 3,655,186 | 4/1972 | Bayha | 271/180 |
| 3,804,266 | 4/1974 | Forthmann, Jr. | 271/180 X |
| 3,977,669 | 8/1976 | Douno | 271/180 |
| 4,103,885 | 8/1978 | Fox | 271/265 X |
| 4,275,814 | 6/1981 | Kageyama et al. | 206/455 |
| 4,290,594 | 9/1981 | Ludemann et al. | 271/180 |
| 4,619,450 | 10/1986 | Anderson et al. | 271/161 X |
| 4,724,463 | 2/1988 | Matsumoto | 355/29 |
| 4,813,661 | 3/1989 | Wegel et al. | 271/224 X |
| 5,071,112 | 12/1991 | Signoretto | 271/180 |

FOREIGN PATENT DOCUMENTS

| | | | |
|---|---|---|---|
| 3127540 | 6/1982 | Germany | 271/223 |
| 58494 | 5/1979 | Japan | 271/180 |
| 81050 | 5/1982 | Japan | 271/207 |
| 81049 | 5/1982 | Japan | 271/207 |
| 109359 | 6/1983 | Japan | 271/221 |
| 31970 | 2/1988 | Japan | 271/221 |

*Primary Examiner*—H. Grant Skaggs
*Assistant Examiner*—Carol L. Druzbick
*Attorney, Agent, or Firm*—Sughrue, Mion, Zinn, Macpeak & Seas

[57] ABSTRACT

Disclosed herein is a negative film accumulating apparatus for accumulating therein a plurality of negative films successively fed from a photographic printer or the like. The negative films fed from the previous process such as the photographic printer or the like are placed on a supporter employed in the negative film accumulating apparatus. The rear end of each of the negative films is pressed in the film thickness direction by a pressure block. Each of the negative films thus pressed is accumulated in a holder. The pressure block presses against the negative films each time the negative films are successively delivered. It is therefore possible to accumulate the rear ends of the negative films in the holder in a stack.

14 Claims, 10 Drawing Sheets

NEGATIVE FILM ACCUMULATING APPARATUS

This is a continuation of application Ser. No. 08/053,825, filed Apr. 29, 1993, now abandoned, which in turn is a continuation of application Ser. No. 07/833,519, filed Feb. 11, 1992, now abandoned.

BACKGROUND OF THE INVENTION

1. Field of the Invention

The present invention relates to a negative film accumulating apparatus for accumulating therein negative films delivered from equipment such as a printer, an automatic developing apparatus, etc.

2. Description of the Related Art

After an elongated negative film is fed to a printer and a process for printing the film has been carried out by the printer, an operator takes out the negative film from an outlet of the printer and hitches the same on a hook or the like. Therefore, it is necessary for the operator to take out each of a plurality of negative films each time a film printing process is finished when the negative films are supplied to the printer. Accordingly, the negative films are not automatically accumulated.

SUMMARY OF THE INVENTION

With the foregoing in view, it is therefore an object of the present invention to provide a negative film accumulating apparatus for automatically accumulating therein negative films successively fed from a printer or an automatic developing apparatus without causing damage to a surface on which an image is formed.

According to one aspect of the present invention, there is provided a negative film accumulating apparatus for accumulating therein a plurality of films fed in consecutive order, comprising supporting means for placing the films thereon in a stack so as to support the same thereon, and holding means disposed on the supporting means, for holding therein both sides of respective delivery rear ends of the films placed on the supporting means so as to accumulate the films therein.

According to the above-described construction of the present invention, the negative films successively fed from the printer or the automatic developing apparatus are placed on the supporting means. Then, delivery rear ends of the negative films placed on the supporting means are held in a stack within the holding means. Therefore, a bundle of the negative films thus accumulated can be delivered to the following process by simply taking out the holding means from the supporting means with all the films being still in an accumulated state.

The present invention constructed as described above can bring about an excellent effect in that the negative films to be delivered in order from the printer or the automatic developing apparatus can automatically and successively be accumulated.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 1:
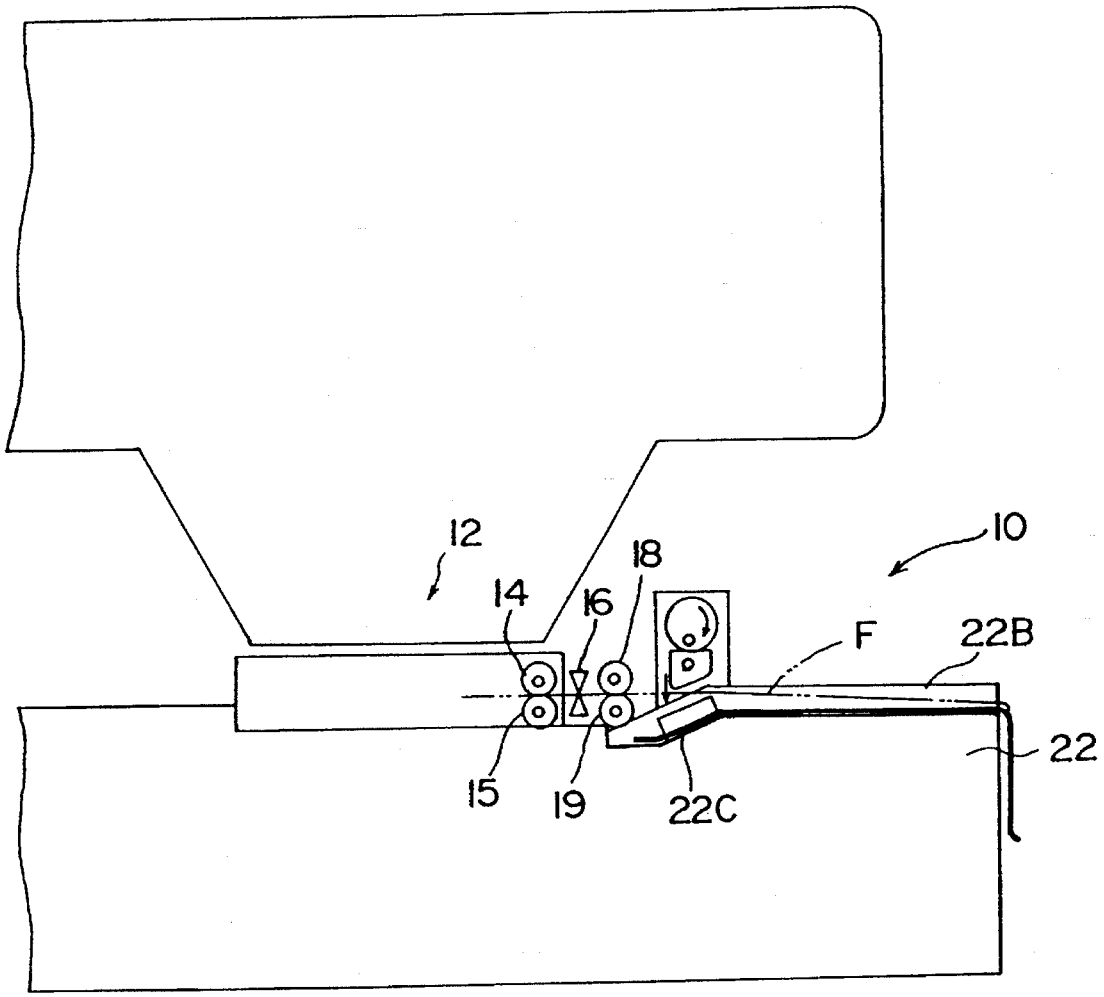
FIG. 1 is a vertical cross-sectional view showing a negative film accumulating apparatus to which a first embodiment of the present invention is to be applied.
Figure 2:
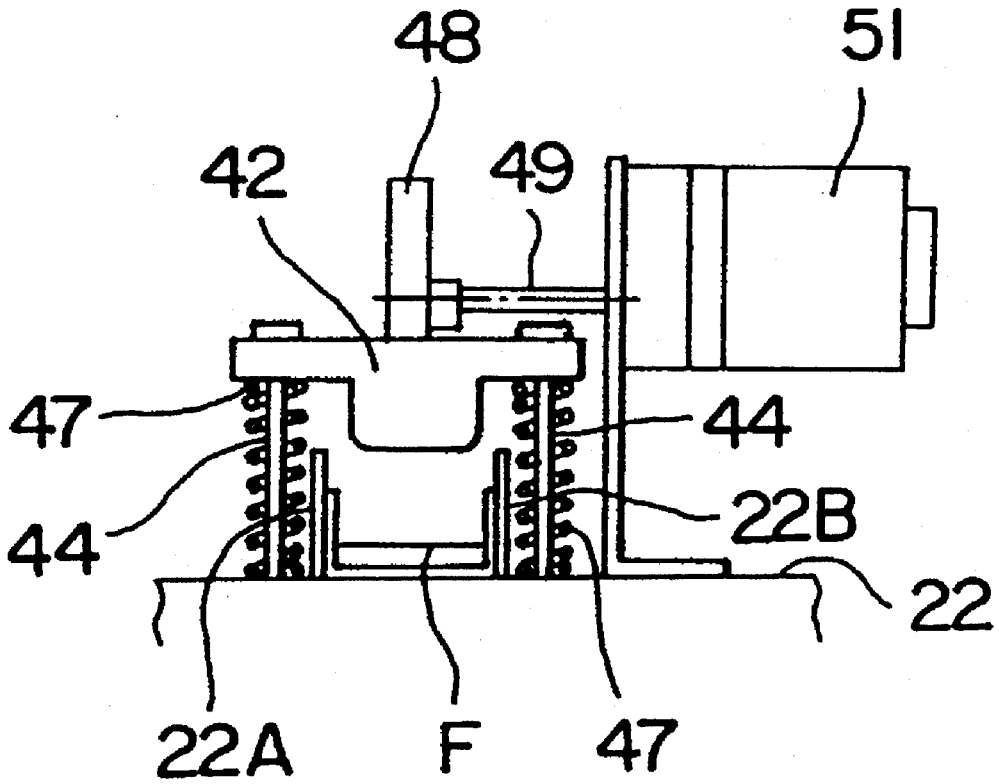
FIG. 2 is a side view showing the negative film accumulating apparatus shown in FIG. 1 as seen in a left to right arrangement.

FIGS. 1 and 2 show a negative film accumulating apparatus 10. In the negative film accumulating apparatus 10, a negative film F after a printing process has been completed by a printing unit 12 passes through a pair of nip-type feed rollers 14, 15, a sensor 16 and a pair of nip-type feed rollers 18, 19 all of which are disposed at the rear end of the printing unit 12 and is delivered toward a desired position. A support table 22 is disposed on the downstream side of the rollers 18, 19. The negative film F can be moved downstream while being guided by guides 22A, 22B which are provided upright on both sides of the support table 22. An end of the support table 22 located on the upstream side thereof serves as a slanted portion 22C gradually slanted in a downward direction, whereas the leading end of the support table 22 on the upstream side thereof is placed below the roller 19.

Figure 4:
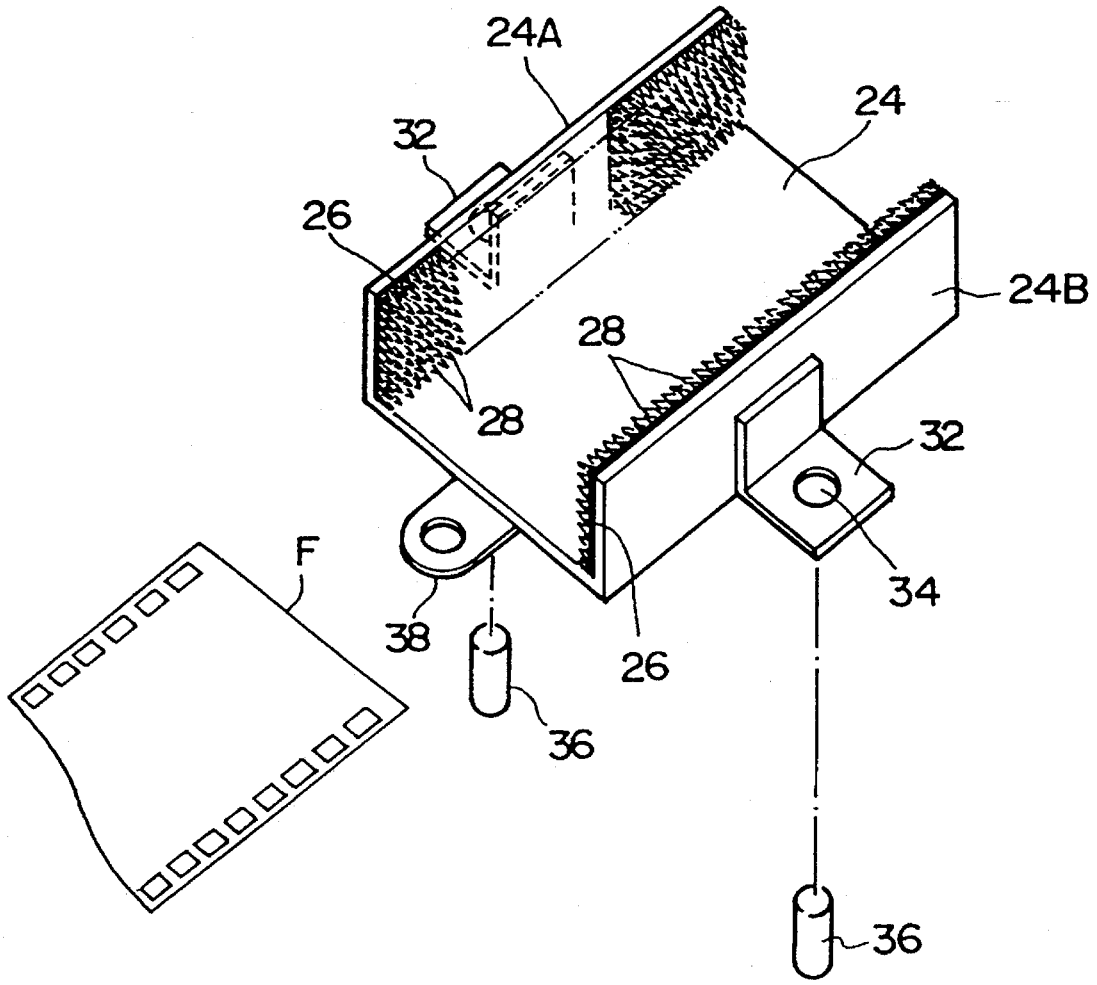
FIG. 4 is a perspective view illustrating a holder.

Mounted on the slanted portion 22C is a holder 24 serving as a film holding means. As shown in FIG. 4, the holder 24 is made from a plate-like member bent into a U-shape. Fabric tapes 26 are applied on the inner opposed surfaces of the vertically-bent side plates 24A, 24B of the holder 24. The space between the fabric tapes 26 on the inner opposed surfaces of the side plates 24A, 24B is identical to the width of the negative film F or slightly wider than the width thereof. The fabric tapes 26 have a plurality of interlocking lugs 28 protruding in an opposing relationship therefrom. As the interlocking lugs 28, for example, either slender fabric lines whose leading ends are bent and made of synthetic resins or looped slender fabric lines whose both ends are fixed to the fabric tapes 26 and which are made of synthetic resins can be used. Both edges of the negative film F are interposed between opposed adjacent interlocking lugs 28 so as to hold the negative film F in the holder 24. When the negative film F is held in a stacked state between the opposed fabric tapes 26, it can be moved in the longitudinal direction thereof by a relatively small force but cannot easily be moved in the thickness direction thereof.

One leg of each of a pair of L-shaped protrusions 32 is fixedly mounted on the respectively corresponding side plates 24A, 24B. Another leg of each of a pair of L-shaped protrusions 32 have through holes 34 defined therethrough. Each of the through holes 34 is used to insert an interlocking pin 36 which projects from the slanted portion 22C therethrough. Accordingly, the holder 24 can easily be positioned and fixed to the support table 22. Further, a tongue 38 projects from a longitudinally-extending end of the holder 24. When the holder 24 is detached from the support table 22 together with the negative film F, it can be hitched on an unillustrated hook so as to be held in place with the longitudinal direction of the negative film F being turned to upward and downward directions.

Figure 3A:
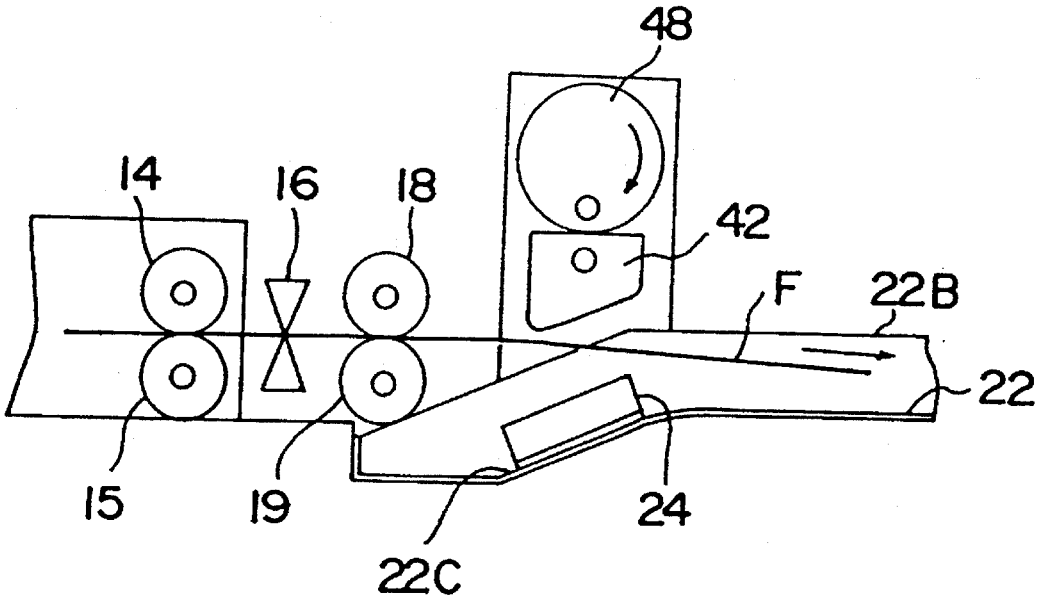
FIGS. 3A and 3B are views for describing the manner in which a negative film shown in FIG. 1 is moved.

As shown in FIG. 2, a pressure block 42 is disposed above the support table 22. Guide posts 44, which extend upright from the support table 22, extend through the pressure block 42. The pressure block 42 can be moved upward and downward along the guide posts 44, and is normally placed in the state shown in FIG. 3A in which it has been withdrawn to an upward position by an urging force of compression coil springs 47.

Figure 3B:
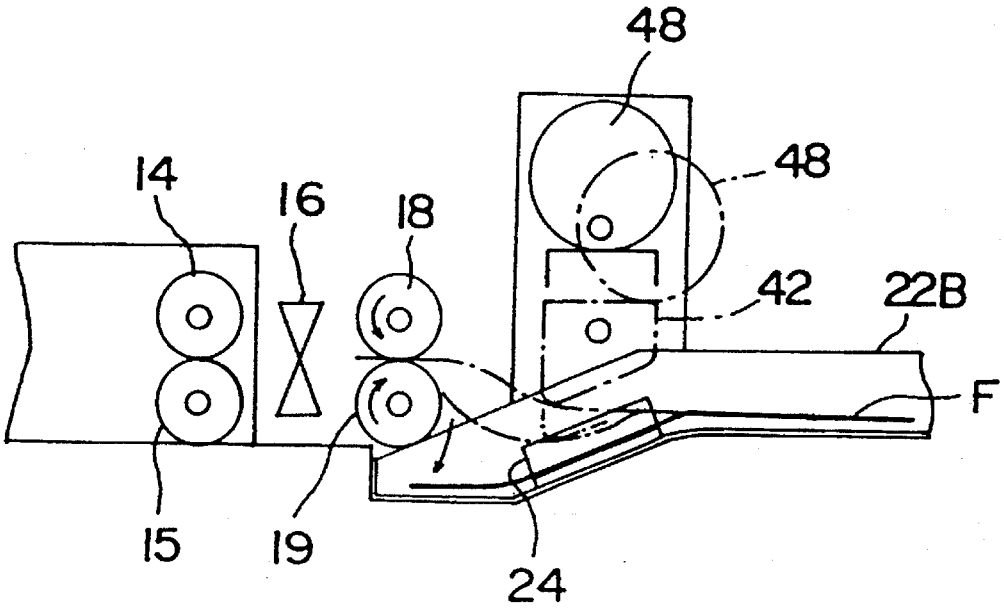

An eccentric cam 48 is disposed on the top face of the pressure block 42, which is placed in an opposing relationship to the surface of the negative film F. A rotatable shaft 49 fixed to the eccentric cam 48 is coupled to an output shaft of a motor 51. Thus, when the motor 51 is energized, the eccentric cam 48 is activated to lower the pressure block 42 as shown in FIG. 3B against the urging force of the compression coil spring 47, thereby accumulating a delivery rear end of the negative film F within the holder 24 in the thickness direction thereof.

The operation of the present embodiment will now be described below.

The printed leading end of a negative film F which has been subjected to a printing process by the printing unit 12 passes through the nip-type feed rollers 14, 15, the sensor 16 and the nip- type feed rollers 18, 19 and is delivered onto the support table 22. While sliding on the support table 22, the leading end of the negative film F is moved toward an end of the support table 22 on the downstream side thereof so as to hang down as shown in FIG. 1. When the printed rear end of the negative film F passes through the sensor 16, the motor 51 is energized to rotate the eccentric cam 48. As a result, the eccentric cam 48 presses the pressure block 42 down, which, in turn, presses the rear end of the negative film F into the holder 24. When the pressure block 42 is lowered at this time in a state in which the rear end of the negative film F is being brought into contact with the roller 19 as illustrated in FIG. 3B, there is produced a force for pressing the rear end of the negative film F in a downward direction by the rotation of the roller 19, thereby making it possible to reliably carry out a process for accumulating the negative film F.

Thus, the pressure block 42 serves to place the rear end of the negative film F on the support table 22 each time the negative film F is delivered from the printing unit 12. Therefore, printed rear ends of a plurality of negative films F are held in the holder 24 in a stacked state. When a predetermined number of negative films F have been accumulated in the holder 24, each of the L-shaped protrusions 32 is pulled from the interlocking pin 36 to take out the holder 24 from the support table 22, after which the holder 24 is hitched on a hook or the like using the tongue 38, thereby making it possible to carry out a process for holding the holder 24 in place.

Figure 5:
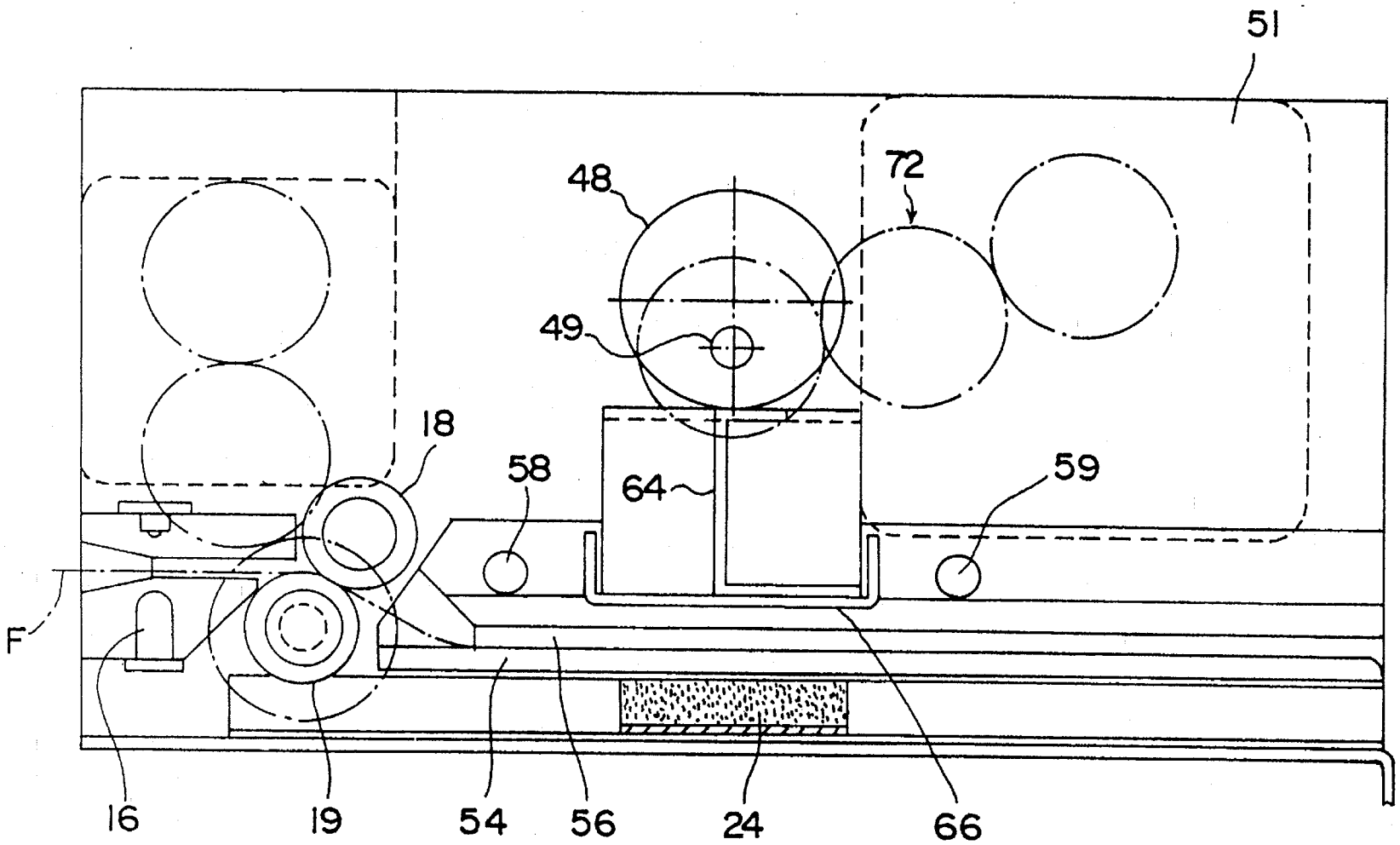
FIG. 5 is a vertical cross-sectional view depicting a negative film accumulating apparatus to which a second embodiment of the present invention is to be applied.
Figure 6:
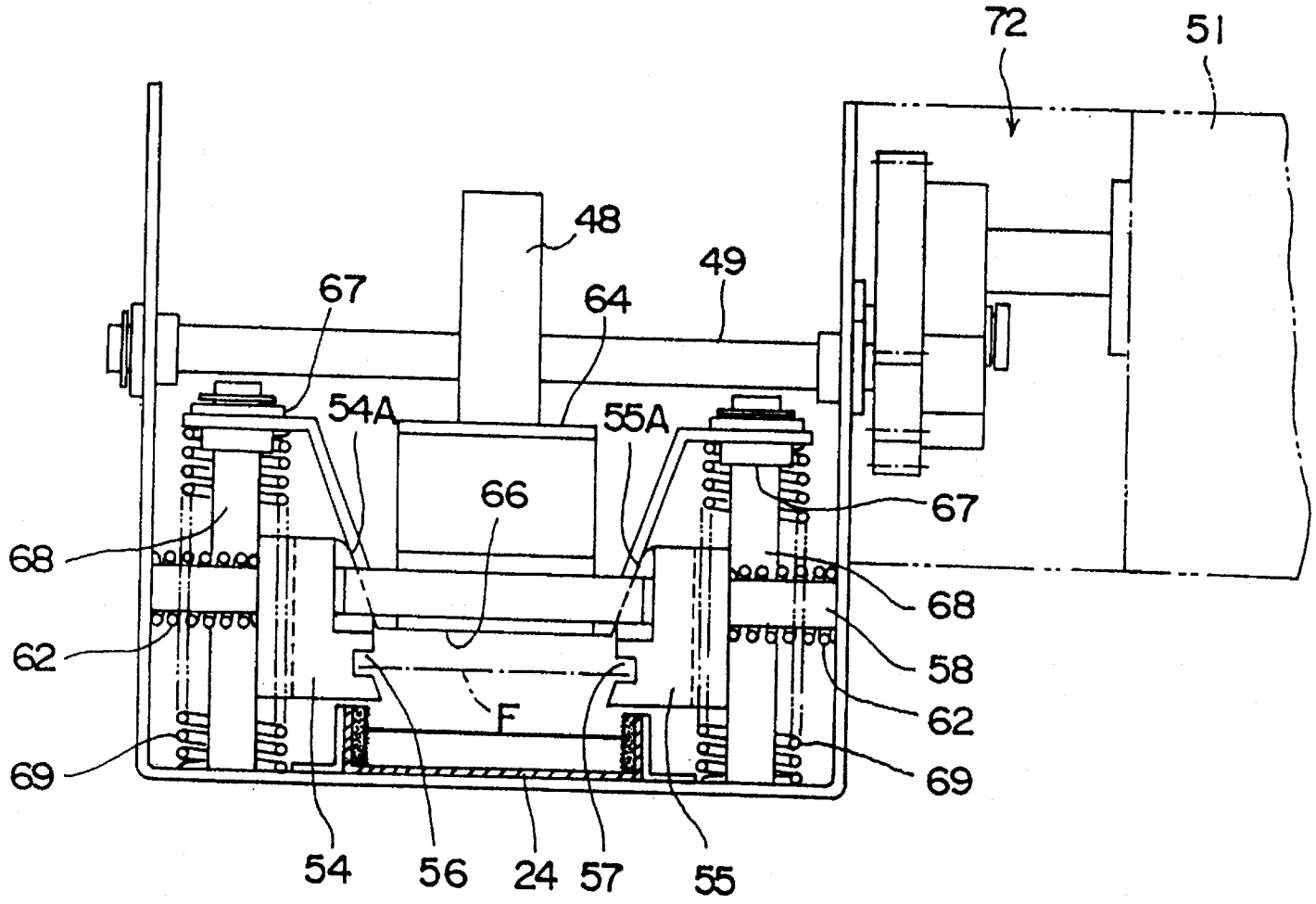
FIG. 6 is a side view showing the negative film accumulating apparatus depicted in FIG. 5 as seen in a left to right arrangement.
Figure 7:
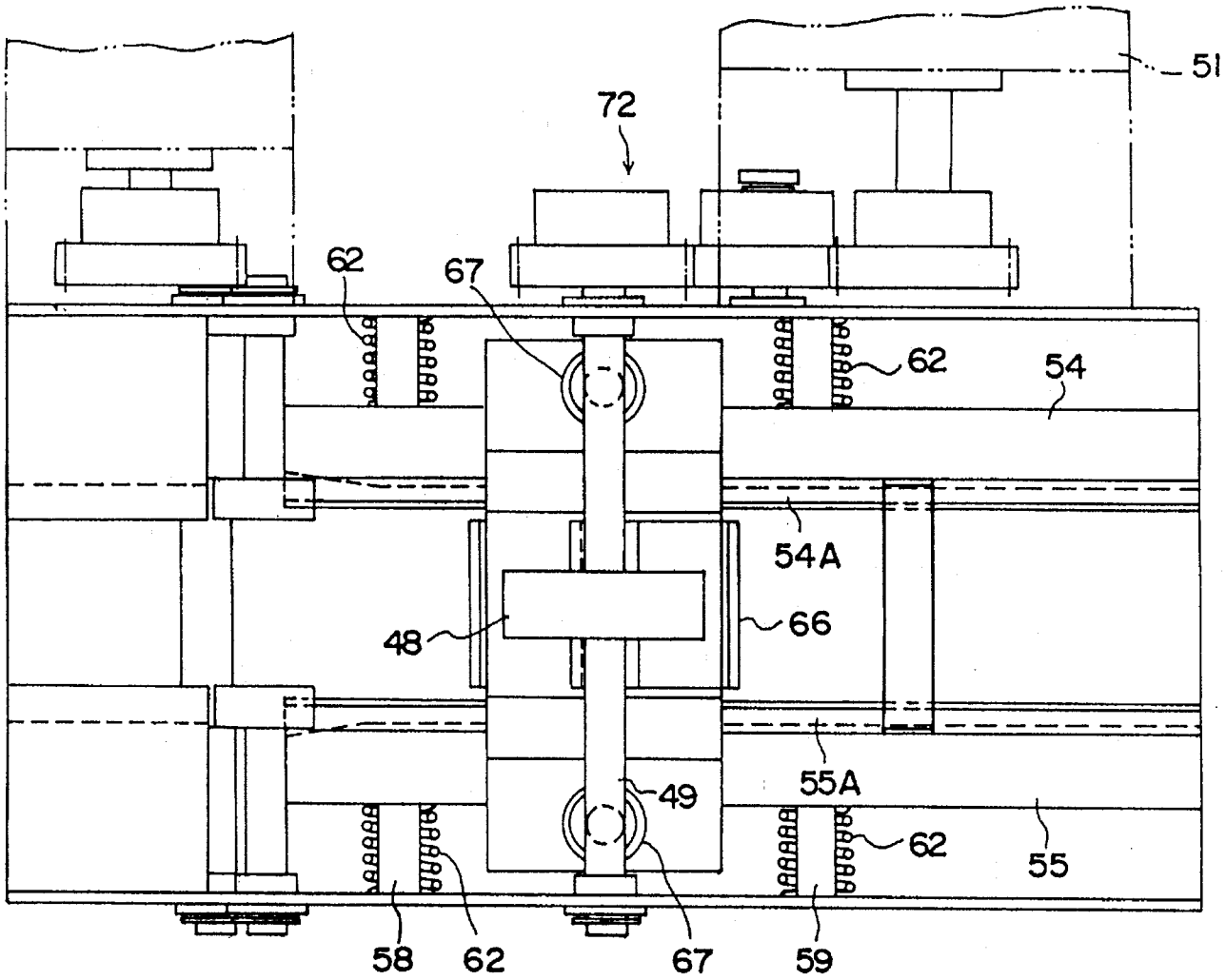
FIG. 7 is a plan view illustrating the negative film accumulating apparatus shown in FIG. 5.

Next, FIGS. 5 through 7 show a second embodiment of the present invention. In the present embodiment, a line that is tangent between nip-type feed rollers 18 and 19 slopes downward. A negative film F delivered under this condition is slightly oriented downward and guided into slits 56, 57 defined in opposed faces of guide blocks 54, 55 respectively. The slits 56, 57 accommodate both edges of the negative film F therein, and hence an image portion formed in a transversely-extending central portion of the negative film F is brought into a non-contact state.

The guide blocks 54, 55 respectively have guide shafts 58, 59 disposed along the transverse direction of the negative film F and extend therethrough. In addition, the guide blocks 54, 55 can be moved toward and away from each other. A pair of compression coil springs 62 mounted on the guide shafts 58, 59 respectively urges the guide blocks 54, 55 in the direction in which they approach each other.

Then, opposed faces of the guide blocks 54, 55 at upper ends thereof are shaped in the form of tapered faces 54A, 55A. An upwardly and downwardly movable bracket 66 is interposed between the tapered faces 54A and 55A. The bracket 66 has opposed outer surfaces held in face-to-face contact with the tapered faces 54A, 55A, and upper ends bent in the horizontal direction, onto which a pair of sleeves 67 is fixedly mounted. The sleeves 67 can be moved in upward and downward directions along a pair of guide posts 68 vertically disposed on a support table (not shown). In addition, the sleeves 67 are urged upward by a pair of compression coil springs 69. That is, the bracket 66 is normally urged in the direction in which it is pulled out from between time guide blocks 54 and 55.

An eccentric cam 48 is disposed in confronting relation on an upper end face of a pressure bracket 54 fixedly mounted in the bracket 66. The eccentric cam 48 has a rotatable shaft 49 coupled to a motor 51 via a reduction gear train 72. Thus, when the motor 51 is energized, the eccentric cam 48 lowers the pressure bracket 64 and the bracket 66 so as to move the guide blocks 54, 55 away from each other and release the negative film F from between the tapered faces 54A and 55A to be pressed in the downward direction, thereby enabling the negative film F to be accommodated in a holder 24 disposed downwardly.

The operation of the present embodiment will now be described below.

A negative film F which has been subjected to a printing process passes through the nip-type feed rollers 18, 19 and is fed between the guide blocks 54 and 55. In this condition, as illustrated in FIG. 6, the guide blocks 54, 55 are placed under restraint in approaching to each other because the bracket 66 has been interposed between the tapered faces 54A and 55A. In addition, both edges of the negative film F are inserted into the corresponding slits 56, 57. When the sensor 15 detects that a printed rear end of the negative film F has passed therethrough, the motor 51 is energized to rotate the eccentric cam 48. Therefore, the pressure bracket 64 and the bracket 66 are lowered to widen the guide blocks 54, 55 under pressure. As a result, both edges of the negative film F are released from restraint, and the negative film F is pressed in the direction of the thickness thereof by the bracket 66 and inserted into the holder 24. Further, when the motor 51 is energized, the bracket 66 is elevated again to return to the state shown in FIG. 6, thereby enabling the next negative film F to be delivered into the holder 24. Since the next negative film F thus delivered does not slide on the negative film F which has already been accommodated in the holder 24, no damage is inflicted on the surface of an image. Thus, a plurality of negative films F are successively superimposed on one another in a stack. The holder 24 is taken from the support table in the same manner as described above in a state in which the rear ends of the negative films F have been accumulated in the holder 24, thereby making it possible to carry out the following process.

The second embodiment describes a case in which the guide blocks 54, 55 are moved toward and away from each other. However, the guide blocks 54, 55 may be moved toward and away from each other by making use of links, gears, screws, etc. as means other than the cam for holding the bracket 66 in engagement with the tapered faces 54A, 55A. The guide blocks 54, 55 employed in the second embodiment may be disposed, as a means for guiding an intermediate portion of the negative film F, on a horizontal region of the support table 22 employed in the first embodiment. At this time, the guide blocks 54, 55 for guiding the intermediate portion of the negative film F may simply be moved toward and away from each other. Further, since the pressure block 42 is activated to press the negative film F in its thickness direction so as to accommodate the same in the holder 24, it is not always necessary that the pressure bracket 64 and the bracket 66 shown in FIG. 6 be provided. It is simply necessary to use a mechanism for moving the guide blocks 54, 56 toward and away from each other.

A third embodiment will now be described. The same elements of structure as those employed in the second embodiment are hereinafter identified by like reference numerals and the description of the elements will therefore be omitted.

Figure 8:
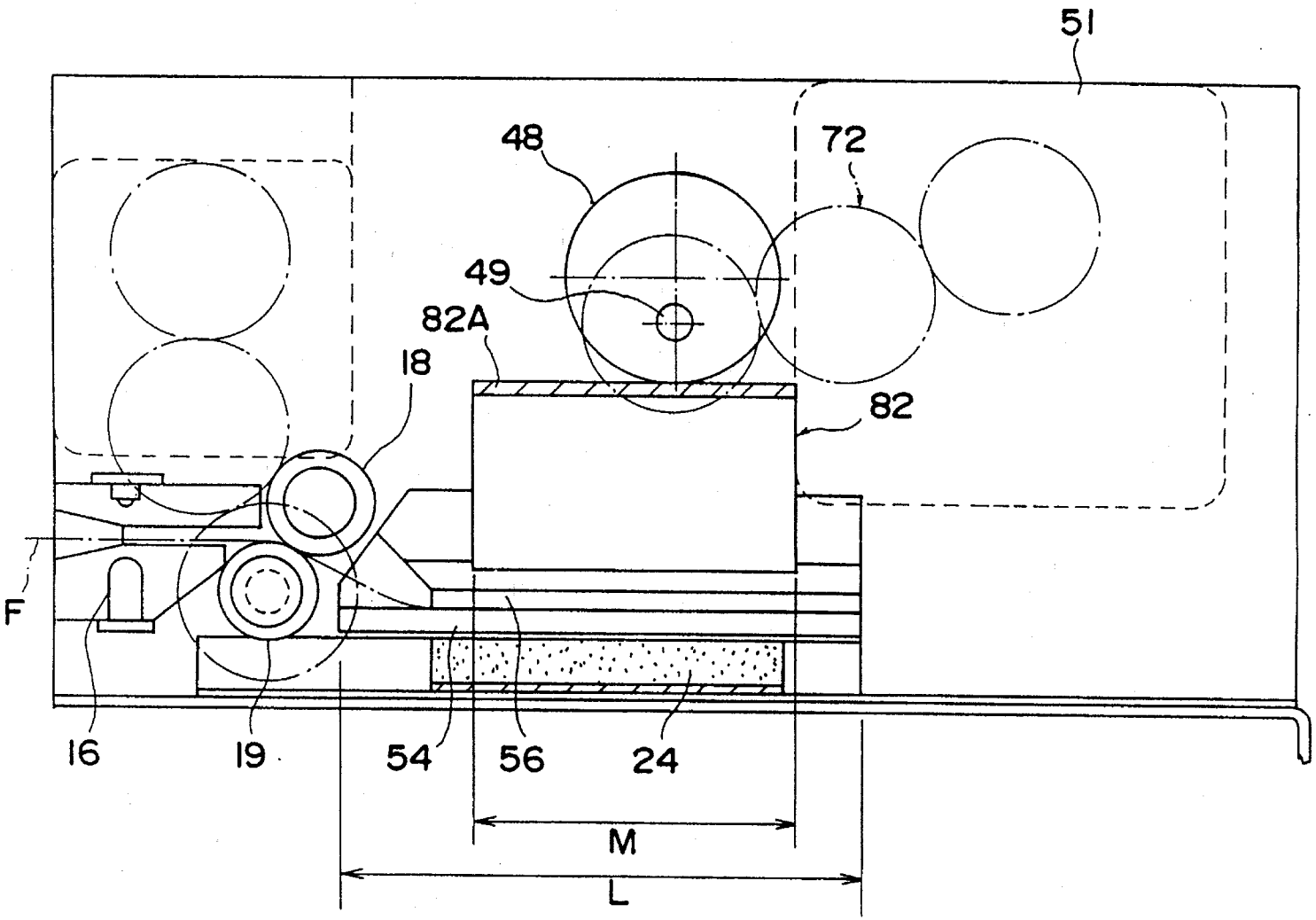
FIG. 8 is a vertical cross-sectional view showing a negative film accumulating apparatus to which a third embodiment of the present invention is to be applied.

In the third embodiment, as shown in FIG. 8, a line that is tangent between nip-type feed rollers 18 and 19 slopes downward in a manner similar to the second embodiment. A negative film F delivered under this condition is slightly oriented downward and guided into slits 56, 57 defined in opposed faces of guide blocks 54, 55 respectively.

The guide blocks 54, 55 are fixed in a negative film accumulating apparatus. A length L of each of the guide blocks 54, 55, which extends along the longitudinal direction thereof (i.e., along the longitudinal direction of a negative film F), is slightly longer than a length M of a pressure block 82, which extends along the longitudinal direction thereof.

The pressure block 82 has an upper end onto which a horizontal flange 82A is formed and a pair of sleeves 67 is fixed. The sleeves 67 can be moved upward and downward along vertically-disposed guide posts 68 and urged upward by a pair of compression coil springs 69.

The guide posts 68 and the compression coil springs 69 have intermediate portions which extend through-holes 71 defined in the guide blocks 54, 55, respectively. The guide blocks 54, 55 and the guide posts 68 do not interfere with one another, and the guide blocks 54, 55 and the compression coil springs 69 do not interfere with one another.

The pressure block 82 is inserted into a space S defined between the guide blocks 54 and 55. Namely, an eccentric cam 48 is correspondingly disposed on an upper end surface of the pressure block 82. The eccentric cam 48 has a rotatable shaft 49 which is coupled to a motor 51 via reduction gear train 72. When the motor 51 is energized to rotate the eccentric cam 48 by one rotation, the pressure block 82 is inserted into the space S from a position above the guide blocks 54, 55. Accordingly, the pressure block 82 is moved upward and downward along a locus defined between a position above the guide blocks 54, 55 and a holder 24, which is located below the guide blocks 54, 55.

Thus, a negative film F which is guided into the slits 56, 57 of the guide blocks 54, 55 and placed on the traveling locus of the pressure block 82, is pressed toward the holder 24 by the downward motion of the pressure block 82.

Figure 10A:
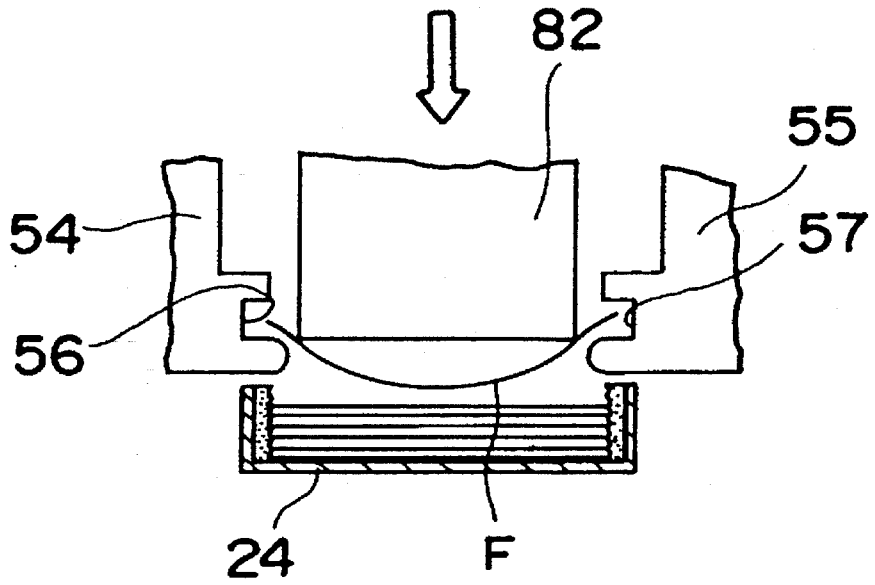
FIGS. 10A and 10B are respectively a view for describing the time at which a pressure block starts moving downward from a position shown in FIG. 9, and a view for describing the time at which the pressure block has reached the lowest position.
Figure 10B:
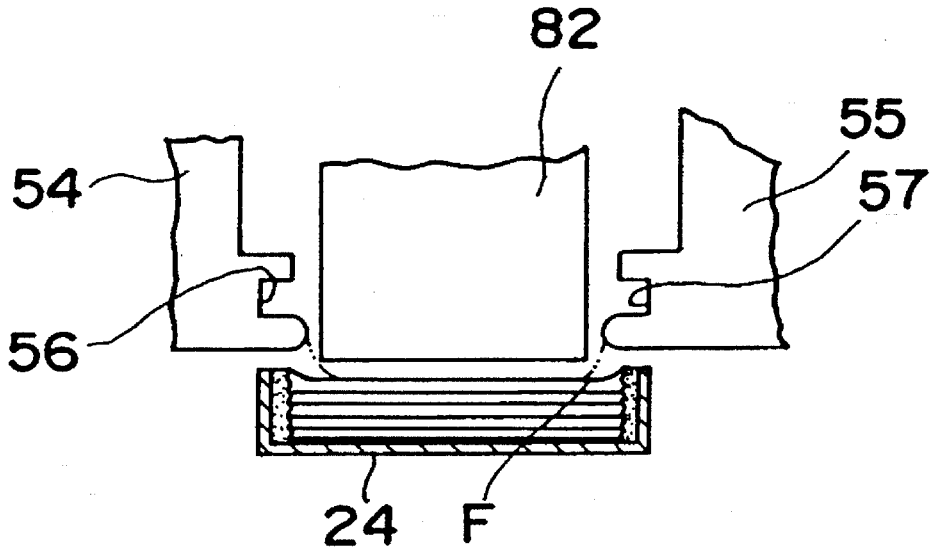

At this time, the film F is bent along its transverse direction so as to produce flexion as seen in the longitudinal direction thereof. Therefore, the flexion of the film is canceled immediately after the film F is separated, i.e., disengaged, from the slits 56, 57 so that the film F is held in the holder 24 (see FIGS. 10A and 10B).

The operation of the third embodiment will now be described below.

Figure 9:
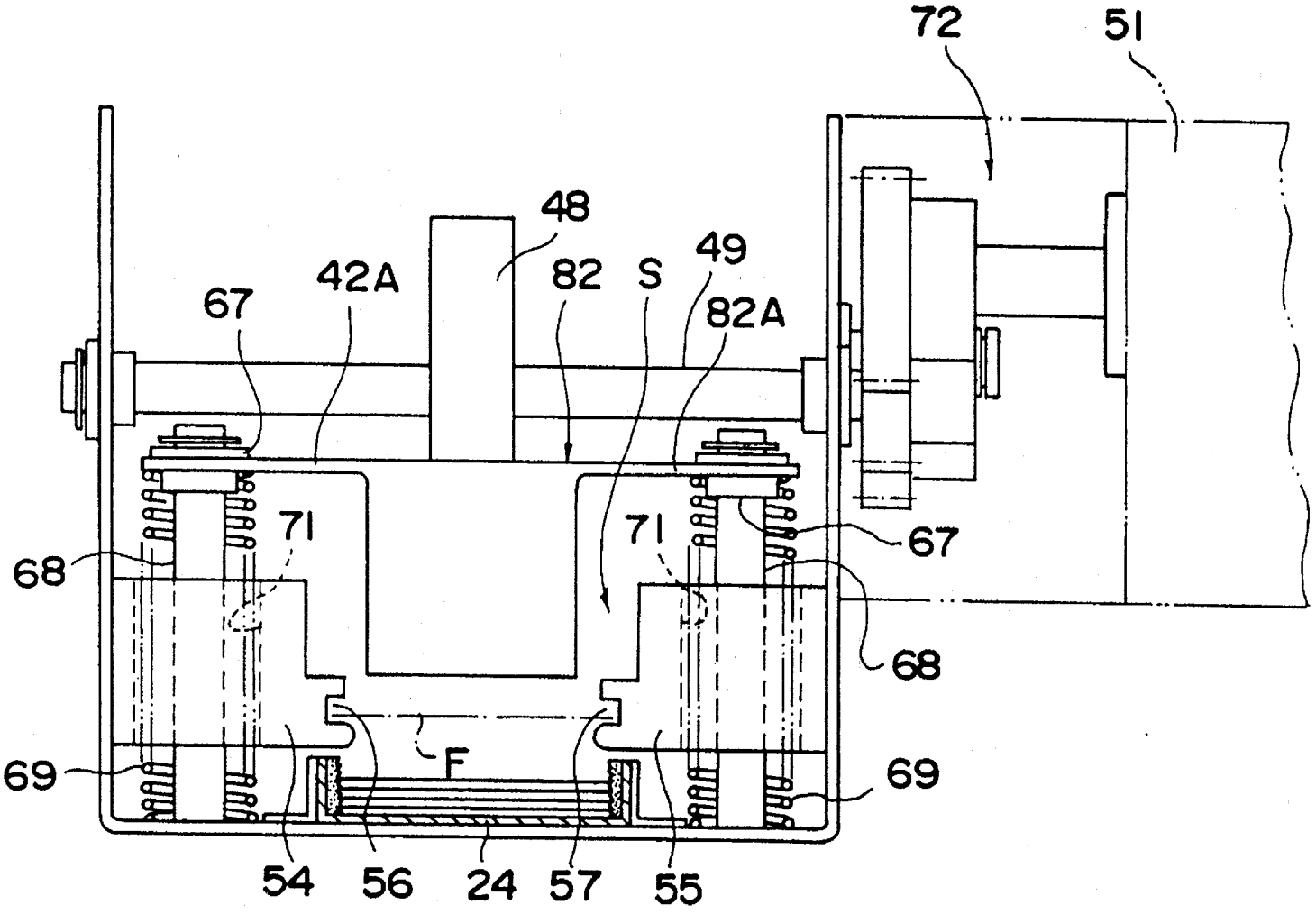
FIG. 9 is a side view illustrating the negative film accumulating apparatus shown in FIG. 8 as seen in a left to right arrangement.

When a negative film F which has been subjected to a printing process passes through the nip-type feed rollers 18, 19 and is fed between the guide blocks 54 and 55, both edges of the negative film F are inserted into the corresponding slits 56, 57. When a sensor- 15 detects that a printed rear end of the negative film F has passed therethrough, the motor 51 is energized to rotate the eccentric cam 48 by one rotation. Therefore, the pressure block 82 is lowered (i.e., moved downward) from the state shown in FIG. 9 so as to enter the space S between the guide blocks 54 and 55 (see FIG. 10A). Since the negative film F is pressed by the pressure block 82, the negative film F is bent along its transverse direction to produce flexion as seen in the longitudinal direction thereof. Both ends of the negative film F which extend in the transverse direction thereof are disengaged from the slits 56, 57 by the flexion (see FIG. 10B).

As soon as both ends of the negative film F are disengaged from the slits 56, 57, the negative film F is released from the flexion, so that both ends of the negative film F extending in the transverse direction thereof are held in the holder 24. Namely, the third embodiment is not constructed in such a manner that the guide blocks 56, 57 are moved toward and away from each other as in the second embodiment. In the third embodiment, the negative film F is bent along the transverse direction thereof so as to be separated from the slits 56, 57. Therefore, the negative film F is held in either the slits 56, 57 of the guide blocks 54, 55 or the holder 24, so that the negative film F is not at any time temporarily released from restraint. Thus, even if torsion develops in either the leading end of the negative film F or the intermediate portion thereof, no variation occurs in the negative film F, thereby making it possible to reliably hold the negative film F in the holder 24.

Next, the pressure block 82 is elevated (i.e., moved upward) again to be withdrawn from the space S between the guide blocks 54 and 55, thereby enabling the next negative film F to be inserted into the holder 24. Thus, a number of negative films F are successively superposed one on top of another. The holder 24 is taken out from the support table in the same manner as described in the first and second embodiments in a state in which the rear ends of the negative films F have been accumulated in the holder 24, thereby making it possible to carry out the following process.

In the third embodiment, the length L extending in the longitudinal direction of each of the guide blocks 54, 55 is slightly longer than the length M extending in the longitudinal direction of the pressure block 82. The negative film F can therefore reliably be disengaged from the slits 56, 57 by the pressure block 82. Thus, when the length in the longitudinal direction of the pressure block 82 is long, the guide blocks 54, 55 can be lengthened correspondingly.

Further, each of discrete guide blocks may be disposed, as a means for guiding an intermediate portion of the negative film F, on a horizontal region of the support table 22. In this case, the guide blocks for guiding the intermediate portion of the negative film F may independently be moved toward and away from each other. It is preferable to move the guide blocks toward and away from each other in synchronism with the operation for pressing the negative film F in the film thickness direction to accommodate the negative film F in the holder 24.

Having now fully described the invention, it will be apparent to those skilled in the art that many changes and modifications can be made without departing from the spirit or scope of the invention as set forth herein.

What is claimed is:

1. A negative film accumulating apparatus for accumulating therein a plurality of negative films fed in consecutive order, comprising:

supporting means for receiving said films so as to superimpose the films on one another;

guiding means extending along a film's longitudinal direction for guiding each of said films in said longitudinal direction thereof in confronting relationship to edges of each of said films, wherein said guiding means comprises first and second guide blocks, said first and second guide blocks having a constant, predetermined distance therebetween;

holding means for holding therein first and second sides of respective sections of said films placed on said supporting means, wherein said holding means disposed below said guiding means has a contact portion which engages said first and second sides, wherein said contact portion is stationary in relation to said supporting means; and pressing means for pressing said respective sections of said films in the film thickness direction so as to accommodate and accumulate the respective sections in said holding means, wherein said holding means simultaneously engages all of said first and second sides of a plurality of said films accumulated in said holding means.

2. A negative film accumulating apparatus according to claim 1, wherein said holding means has a slanted portion formed by downwardly inclining an upstream side thereof extending in the film delivery direction.

3. A negative film accumulating apparatus according to claim 2, wherein said holding means has a pair of opposed side walls which vertically extend from said supporting means in association with transversely-extending edges of each of said films, said side walls having a plurality of elastic interlocking lugs opposed to one another inwardly as viewed in the film transverse direction, said holding means being provided in such a manner that said films can be held therein by interposing said transversely-extending edges between opposed adjacent interlocking lugs.

4. A negative film accumulating apparatus according to claim 3, wherein said transversely-extending edges of each of said films are interposed between opposed adjacent interlocking lugs of said plurality of interlocking lugs, and each of said films can be moved in the film longitudinal direction by a small external force, whereas each of said films can be moved in the film thickness direction by an elastic force corresponding to a large external force required to move each of said films in the same direction.

5. A negative film accumulating apparatus according to claim 3, wherein said holding means is detachably disposed on said supporting means, and is capable of collectively delivering negative films accumulated in said holding means detached therefrom to the following process.

6. A negative film accumulating apparatus according to claim 1, wherein a length of said guiding means, extending along a longitudinal direction thereof, is longer than a length of said pressing means extending along a direction of feed of said negative films.

7. A negative film accumulating apparatus according to claim 1, further comprising guiding means for guiding each of said films in a longitudinal direction thereof in confronting relationship to sides of each of said films, wherein said films are bent by said pressing means along a transverse direction thereof so as to be separated from said guiding means, said negative films at all times being held by one of said guiding means and said holding means.

8. A negative film accumulating apparatus according to claim 1, wherein said length of said guiding means in a longitudinal direction thereof is a predetermined distance longer than a length of said pressing means in a direction of feed of said negative films.

9. A negative film accumulating apparatus according to claim 1, wherein said pressing means has a surface which contacts with substantially an entire central portion of said negative films at least while said films are being initially pressed by said pressing means.

10. A negative film accumulating apparatus for accumulating therein a plurality of negative films fed in consecutive order, comprising:

guiding means extending along a film's longitudinal direction for movably guiding each of said films in the longitudinal direction thereof in confronting relationship to first and second sides of each of said films;

pressing means for successively pressing negative films held by said guiding means, in a film thickness direction so as to move said films away from said guiding means;

holding means disposed below said guiding means for holding therein first and second sides of respective sections of said films after said films have been moved away from said guiding means by said pressing means; and supporting means disposed in such a manner as to contact said holding means, for supporting said films thereon in a stack, wherein said holding means simultaneously engages all of said first and second sides of a plurality of said films accumulated in said holding means with a contact portion.

11. A negative film accumulating apparatus according to claim 10, wherein said guiding means have grooves defined therein, said grooves extending along the film longitudinal direction and receiving transversely-extending edges of each of said films therein so as to permit movement of each of said films along said guiding means.

12. A negative film accumulating apparatus according to claim 10, wherein said pressing means presses transversely-extending intermediate portions of said films, which are held by said guiding means, so as to bend said films in the film transverse direction, thereby releasing said intermediate portions from being held by said guiding means.

13. A negative film accumulating apparatus for accumulating therein a plurality of negative films fed in consecutive order, comprising:

guiding means for movably guiding each of said films in the longitudinal direction thereof in confronting relationship to first and second sides of each of said films;

pressing means for successively pressing negative films held by said guiding means, in a film thickness direction so as to move said films away from said guiding means;

holding means for holding therein first and second sides of respective delivery rear ends of said films moved downward by said pressing means; and supporting means disposed in such a manner as to contact said holding means, for receiving said films in a stack, wherein said holding means includes a pair of opposed side Walls which vertically extend from said supporting means in association with transversely-extending edges of each of said films, said side walls having a plurality of elastic interlocking lugs opposed to one another inwardly as viewed in the film transverse direction, said holding means being provided such that said films can be held therein by interposing said transversely-extending edges between opposed adjacent interlocking lugs; and wherein said holding means is detachably disposed on said supporting means, and is capable of collectively delivering films accumulated in said holding means detached therefrom a following process.

14. A negative film accumulating apparatus according to claim 13, wherein said transversely-extending edges are interposed between opposed adjacent interlocking lugs of said plurality of interlocking lugs, and each of said films can be moved in the longitudinal direction thereof by a small external force, whereas each of said films can be moved in the film thickness direction by an elastic force corresponding to a large external force required to move each of said films in the same direction.

* * * * *